US011183329B2

(12) United States Patent
Yamaguchi et al.

(10) Patent No.: US 11,183,329 B2
(45) Date of Patent: Nov. 23, 2021

(54) REACTOR AND METHOD FOR PRODUCING THE SAME

(71) Applicant: SUMIDA CORPORATION, Tokyo (JP)

(72) Inventors: Takayuki Yamaguchi, Ueda (JP); Toshio Uchibori, Miyota-machi (JP)

(73) Assignee: SUMIDA CORPORATION, Tokyo (JP)

( * ) Notice: Subject to any disclaimer, the term of this patent is extended or adjusted under 35 U.S.C. 154(b) by 201 days.

(21) Appl. No.: 15/824,425

(22) Filed: Nov. 28, 2017

(65) Prior Publication Data

US 2018/0233281 A1 Aug. 16, 2018

(30) Foreign Application Priority Data

Feb. 16, 2017 (JP) ..... JP2017-027320

(51) Int. Cl.
*H01F 27/22* (2006.01)
*H01F 41/061* (2016.01)
(Continued)

(52) U.S. Cl.
CPC ..... *H01F 41/061* (2016.01); *H01F 27/06* (2013.01); *H01F 27/22* (2013.01); *H01F 27/255* (2013.01);
(Continued)

(58) Field of Classification Search
CPC .... H01F 41/061; H01F 27/2847; H01F 27/22; H01F 27/325; H01F 27/32; H01F 27/255;
(Continued)

(56) References Cited

U.S. PATENT DOCUMENTS 3,007,125 A * 10/1961 Furbee ..... H01F 30/10 336/221
3,332,049 A * 7/1967 Hisano ..... H01F 27/266 336/83
(Continued)

FOREIGN PATENT DOCUMENTS

CN 105742007 A 7/2016
CN 105869828 A 8/2016
(Continued)

OTHER PUBLICATIONS

Sep. 9, 2020 Office Action issued in Japanese Patent Application No. 2017-027320.
(Continued)

*Primary Examiner* — Tuyen T Nguyen
(74) *Attorney, Agent, or Firm* — Oliff PLC

(57) ABSTRACT

An art includes a core part 10 provided with central leg parts 13A, 13B and right and left leg parts 11A, 11B, 12A, 12B arranged on both sides of the central leg parts 13A, 13B; a coil part 20 formed by winding a conducting wire around a circumference of the central leg parts 13A, 13B; and a heat transfer sheet 30 for dissipating heat in the coil part 20 to outside, in which the coil part 20 is configured in such a manner that a rectangular wire is wound around the circumference of the central leg parts by edgewise winding and a circumference of the coil part 20 wound therearound is abutted on the heat transfer sheet 30.

10 Claims, 8 Drawing Sheets

(51) Int. Cl.

| | |
|---|---|
| ***H01F 27/28*** | (2006.01) |
| ***H01F 37/00*** | (2006.01) |
| ***H01F 27/42*** | (2006.01) |
| ***H01F 27/06*** | (2006.01) |
| ***H01F 27/32*** | (2006.01) |
| ***H01F 27/255*** | (2006.01) |
| ***H01F 41/12*** | (2006.01) |

(52) U.S. Cl.
CPC ..... *H01F 27/2823* (2013.01); *H01F 27/2847* (2013.01); *H01F 27/32* (2013.01); *H01F 27/325* (2013.01); *H01F 27/42* (2013.01); *H01F 37/00* (2013.01); *H01F 41/12* (2013.01)

(58) Field of Classification Search
CPC ..... H01F 41/12; H01F 27/2823; H01F 37/00; H01F 27/42; H01F 27/06; H01F 17/04; H01F 27/306; H01F 2017/046; H01F 2017/048
See application file for complete search history.

(56) References Cited

U.S. PATENT DOCUMENTS

| | | | | | |
|---|---|---|---|---|---|
| 4,352,081 | A * | 9/1982 | Kijima | H01F 27/306 | 336/198 |
| 5,210,513 | A * | 5/1993 | Khan | H01F 27/22 | 336/233 |
| 8,525,629 | B2 * | 9/2013 | Inaba | H01F 37/00 | 336/55 |
| 10,134,522 | B2 * | 11/2018 | Zhang | H01F 27/2852 | |
| 10,141,093 | B2 * | 11/2018 | Inaba | H01F 27/306 | |
| 2008/0218300 | A1 * | 9/2008 | Loef | H01F 27/10 | 336/58 |
| 2012/0326829 | A1 * | 12/2012 | Matsuda | H01F 27/2823 | 336/212 |
| 2013/0099883 | A1 * | 4/2013 | Sato | H01F 27/08 | 336/55 |
| 2013/0107580 | A1 * | 5/2013 | Inaba | H01F 27/306 | 363/16 |
| 2013/0114319 | A1 * | 5/2013 | Inaba | H01F 27/025 | 363/131 |
| 2013/0222100 | A1 * | 8/2013 | Nomura | H01F 27/025 | 336/55 |
| 2014/0176291 | A1 | 6/2014 | Zheng et al. | | |
| 2016/0189846 | A1 | 6/2016 | Miyauchi et al. | | |
| 2016/0217916 | A1 | 7/2016 | Yan et al. | | |
| 2018/0322995 | A1 * | 11/2018 | Kim | H01F 27/18 | |

FOREIGN PATENT DOCUMENTS

| | | | | |
|---|---|---|---|---|
| CN | 106415750 | A | | 2/2017 |
| JP | H05-021232 | A | | 1/1993 |
| JP | 2010147130 | A | * | 7/2010 |
| JP | 2012-023267 | A | | 2/2012 |
| JP | 2012-124401 | A | | 6/2012 |
| JP | 2013-051402 | A | | 3/2013 |
| JP | 2014138045 | A | * | 7/2014 |
| JP | 2015-188022 | A | | 10/2015 |
| JP | 2016-092313 | A | | 5/2016 |
| WO | 2015199044 | A1 | | 12/2015 |

OTHER PUBLICATIONS

Oct. 2020 Office Action issued in Chinese Patent Application No. 201711102757.1.
Feb. 19, 2021 Office Action issued in Chinese Patent Application No. 201711102757.1.
Apr. 5, 2021 Office Action issued in Japanese Patent Application No. 2017-027320.

* cited by examiner

EMBODIMENT (TRAPEZOID-LIKE SHAPE)

MODIFIED SHAPE (TRIANGLE-LIKE SHAPE)

CONVENTIONAL TECHNOLOGY 1 (CIRCLE-LIKE SHAPE)

CONVENTIONAL TECHNOLOGY 2 (SQUARE-LIKE SHAPE)

EXAMPLE

COMPARATIVE EXAMPLE

REACTOR AND METHOD FOR PRODUCING THE SAME

RELATED APPLICATION

This invention claims the benefit of Japanese Patent Application No. 2017-027320 which is hereby incorporated by reference.

BACKGROUND OF THE INVENTION

Technical Field

The present invention relates to a coil component used as a reactor or the like and a method for producing the coil component, and more specifically, to a reactor for a large current application, in which size reduction can be achieved, and a method for producing the same.

Technical Background

A coil component such as a reactor can generate inductance by being formed into a configuration in which a winding coil is wound around a magnetic core.

In recent years, requests for size reduction have been increasing particularly in an on-vehicle reactor, and along therewith, developments are made on a daily basis on such a structure in which heat generated therein can be effectively dissipated to an outside of the component.

In general, a structure is formed in the reactor, in which a heat sink (water in the case of a water cooled type) is provided below a bottom surface of a coil housing, and the above-described heat generated therein is released to outside through this heat sink, while being cooled.

Then, in order to increase the above-described heat-dissipating effect, heat transfer to the heat sink is designed to be favorable so as to press an outer peripheral portion of a winding coil wound around the magnetic core onto a heat-dissipating sheet (hereinafter, referred to as a heat transfer sheet) attached on a position facing the heat sink through a housing plate (see Patent Documents 1 and 2 below).

RELATED PRIOR ART

Patent Document 1: Japanese Laid-Open Patent Publication No. 2012-124401 (A)

Patent Document 2: Japanese Laid-Open Patent Publication No 2015-188022 (A)

SUMMARY OF THE INVENTION

Incidentally, as a reactor, various types of materials are known according to use applications from a large capacity material for a transmission system to a communicator component. In particular, in view of a large heat generation quantity in a coil in the large capacity material, a desire has been expressed for a technology according to which efficiency of heat dissipation can be further improved to come out in order to achieve size reduction with regard to a size of the reactor. In particular, when the coil is formed by multilayer solenoid winding, for example, even if a conducting wire positioned in an outermost periphery is pressed onto the heat transfer sheet, it requires time and is not efficient to transfer, to the heat transfer sheet, the heat generated in an inner periphery in which the heat generation quantity in the coil is large.

The present invention has been made in view of the above-described circumstances. In particular, even when size reduction is achieved in the reactor for large capacity use, the present invention is contemplated for providing a reactor from which heat generated therein can be efficiently dissipated to an outside of a component, and a method for producing the same.

In order to solve the above-described problems, the reactor and the method for producing the reactor according to the present invention have the features described below.

The reactor according the present invention includes:

a core part provided with central leg parts and right and left leg parts arranged on both sides of the central leg parts;

a coil part formed by winding a conducting wire around a circumference of the central leg parts; and a heat transfer sheet for dissipating heat in the coil part to outside, in which the coil part is arranged in such a manner that a rectangular wire is configured to be wound around the circumference of the central leg parts by edgewise winding, and a circumference of the coil part wound therearound is abutted on the heat transfer sheet.

It is preferable that the coil part is formed into a trapezoidal shape, in which a lower base on a side abutting on the heat transfer sheet has a length as large as one and a half times or more a length of an upper base in a winding shape of one turn in the coil part, and a minimum of interior angles is 60 degrees or more.

Moreover, it is preferably that the coil part is formed into a triangle, a quadrangle or a pentagon in the winding shape of one turn of the coil part, in which a length of a side abutting on the heat transfer sheet is in a maximum length among all sides and a minimum of interior angles is 60 degrees or more.

It is preferable that, in cross-sectional shapes of the central leg parts and the right and left leg parts, perpendicular to a direction in which the central leg parts extend, while a right and left width in a direction of arranging the leg parts is larger in the central leg parts, a vertical length in a direction perpendicular to the direction of arranging the leg parts is formed to be longer in the right and left leg parts, and cross-sectional areas of the cross-sectional shapes are set so as to come close to each other.

Further, it is preferable that a configuration is formed, in which a length of bobbins of the right and left leg parts each is set to be longer than a length of the coil part wound around the central leg parts, in a vertical direction being a direction perpendicular to a plane including the directions of the central leg parts and arranging the right and left leg parts, and when a sealing resin is filled into a space surrounded by the bobbins of the right and left leg parts, the sealing resin filled therein causes no overflow to outside, and the coil part can be wholly covered with the sealing resin.

It is preferable that the coil part is formed by combining two substantially E-shaped partial cores in such a manner that leading end portions of three leg parts corresponding to each other are faced with each other.

It is preferable that the right and left leg parts of the partial cores are formed into a shape so as to come along an outer shape of the coil part wound, in a trapezoidal shape in a cross section, around a circumference of the central leg parts.

It is preferable that the central leg parts are configured, in which a magnetic portion and a spacer portion are alternately arranged in an axial direction.

It is preferable that the reactor includes an aluminum case in which the bobbins are wholly stored.

Further, the method for producing the reactor according to the present invention includes:

arranging a core part in such a manner that a predetermined magnetic path is formed by providing central leg parts, and right and left leg parts so as to be arranged on both sides of the central leg parts;

forming a coil part by winding a conducting wire formed of a rectangular wire around a circumference of the central leg parts by edgewise winding; and pressing part of a circumferential portion of the coil part wound therearound onto a heat transfer sheet for dissipating heat to outside.

Further, it is preferable that the method includes: housing the core part and the coil part in bobbins covering the right and left leg parts; setting the resulting material in an insert molding machine in a state in which the bobbins are wholly stored within a case; filling an inside of the bobbins with an insulating resin agent through a filling hole part; and then applying integral molding processing thereto within a mold.

Here, the above-described expression "winding edgewise" or "edgewise winding" means operation of longitudinally winding a rectangular wire with a short side being one side edge of a rectangular wire material as an inner diameter surface.

According to the reactor of the present invention, the rectangular wire is used as the coil part wound around the circumference of the central leg parts, and therefore the reactor is preferable for passing a large capacity current therethrough. Furthermore, the rectangular wire is wound around the circumference of the central leg parts by edgewise winding, and in each turn of the coil part, an inner periphery and an outer periphery are formed as one side edge and the other side edge of the same rectangular wire material, respectively. Therefore, heat can be quickly transferred from a coil inner peripheral part easily heated at high temperature to the heat transfer sheet abutted on a coil outer peripheral part.

Accordingly, even when the size reduction is achieved in the reactor for large capacity use, the heat generated therein can be effectively dissipated to the outside of the component.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only and thus are not limitative of the present invention.

DESCRIPTION OF THE EMBODIMENTS

A reactor according to an embodiment of the present invention will be described below with reference to drawings.

The reactor is used as an electrical circuit element of various devices to be mounted in an automobile, for example, and is provided with a core part and a coil part wound around the core part, and is ordinarily formed into a configuration in which the core part is inserted into a circumference of the coil part through a bobbin, and the resulting assembly is stored within a case and fixed therein by a filler or the like.

The reactor according to the present embodiment can be preferably used even when a large current is handled for a compact size.

<Main Configuration of Reactor>

Figure 1:
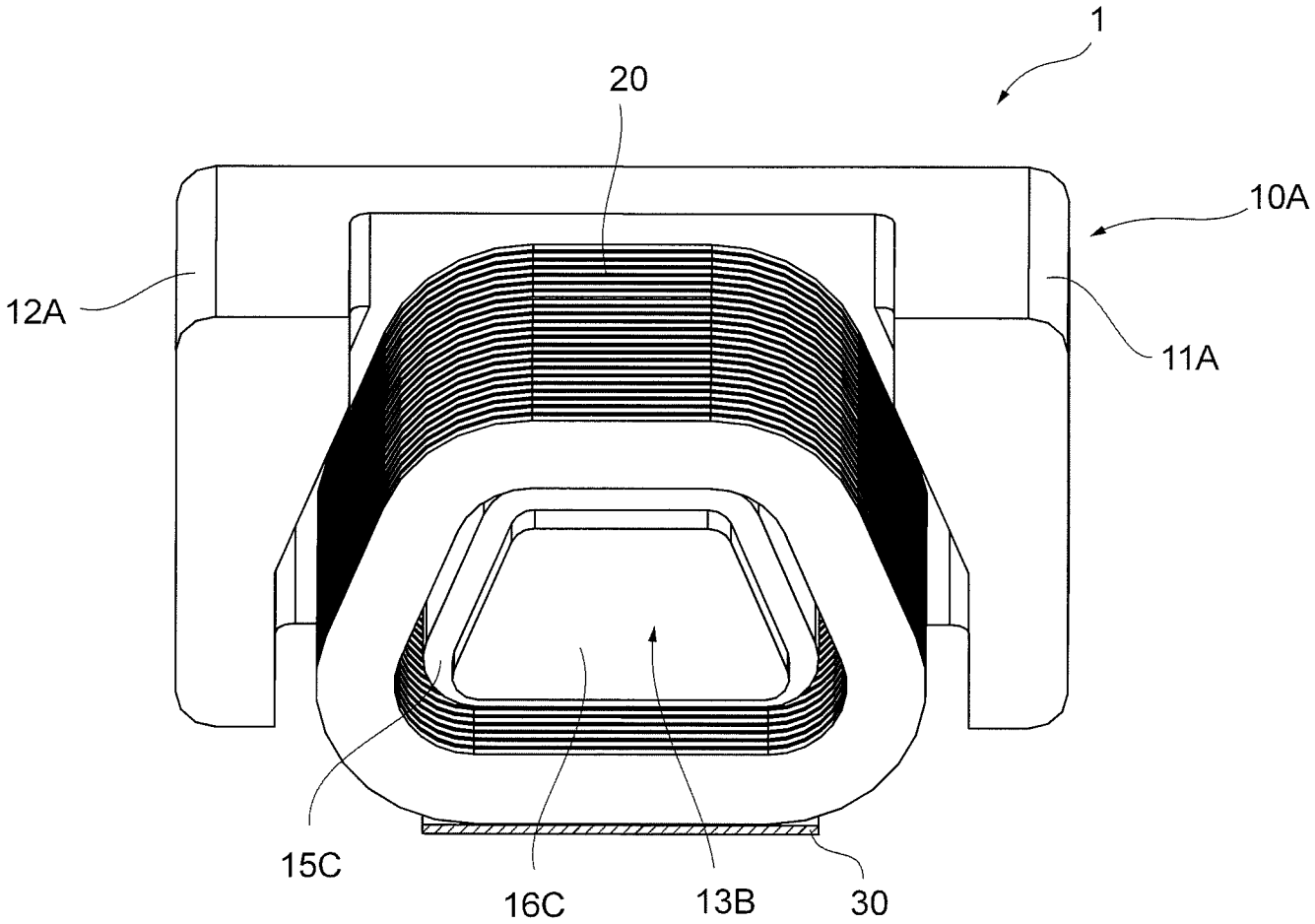
FIG. 1 is a partial cross-sectional perspective view of a core part and a coil part of a reactor according to one embodiment of the present invention.

A reactor 1 according to the present embodiment is provided with a core part 10 formed in combination of a substantially E'-shaped partial core 10A (only one partial core is shown in FIG. 1) with a partial core 10B (see FIG. 3B) facing this partial core 10A, and a coil part 20 wound around a circumference of central leg parts 13A, 13B.

The central leg parts 13A, 13B each are formed into a trapezoidal shape in a cross section, and the coil part 20 wound around the circumference is also formed into the trapezoidal shape in which a rectangular wire is wound therearound by edgewise winding. The coil part 20 can cope with a relatively large current by using the rectangular wire.

As shown in the figure, the coil part 20 is formed into the trapezoidal shape in which a lower base is longer than an upper base in the cross section, and a large outer peripheral surface that forms the lower base is abutted on a heat transfer sheet 30 over a wide area (herein, a side or a surface on a side of the heat transfer sheet 30 is referred to as the lower base). As the reactor is formed into such a compacter configuration, heat dissipation becomes further difficult. However, in the reactor according to the present embodiment, the rectangular wire is wound therearound by edgewise winding, and therefore, in each turn in the coil part 20, an inner periphery and an outer periphery are to be formed as one side edge and the other side edge of the same rectangular wire material, respectively, and heat can be quickly transferred from a coil part inner peripheral part easily heated at high temperature to the heat transfer sheet 30 abutted on a coil outer peripheral part.

The heat transfer sheet 30 faces a heat sink (not shown) (water in the case of water cooling: the same shall apply hereinafter) through a bottom surface wall part of a case 50, and the heat transferred to the heat transfer sheet 30 is dissipated from the heat sink to outside.

Accordingly, even when size reduction is achieved in a reactor for large capacity use, heat generated therein can be efficiently dissipated to an outside of a component.

Moreover, right and left leg parts 11A, 12A of the partial cores 10A, 10B (hereinafter, also referred to as the core part 10 in combination of the partial cores 10A, 10B) each are formed to be wide in an upper part and narrow toward a lower part so as to come along an outer shape of the trapezoidal shape of the coil part 20. Thus, while a shape of the coil part 20 is allowed in the trapezoidal shape, magnetic characteristics of the reactor can be effectively improved.

Figure 2:
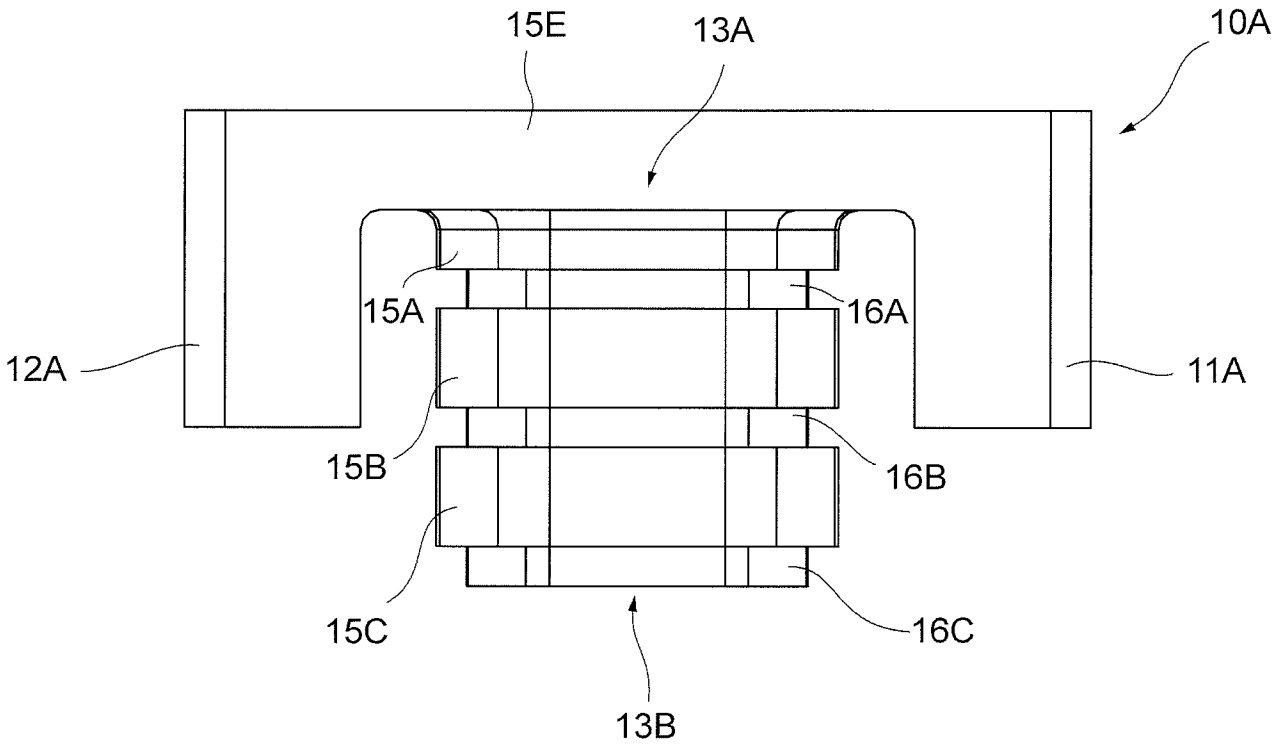
FIG. 2 is a plan view of the core part and the coil part of the reactor according to the embodiment in FIG. 1.
Figure 3A:
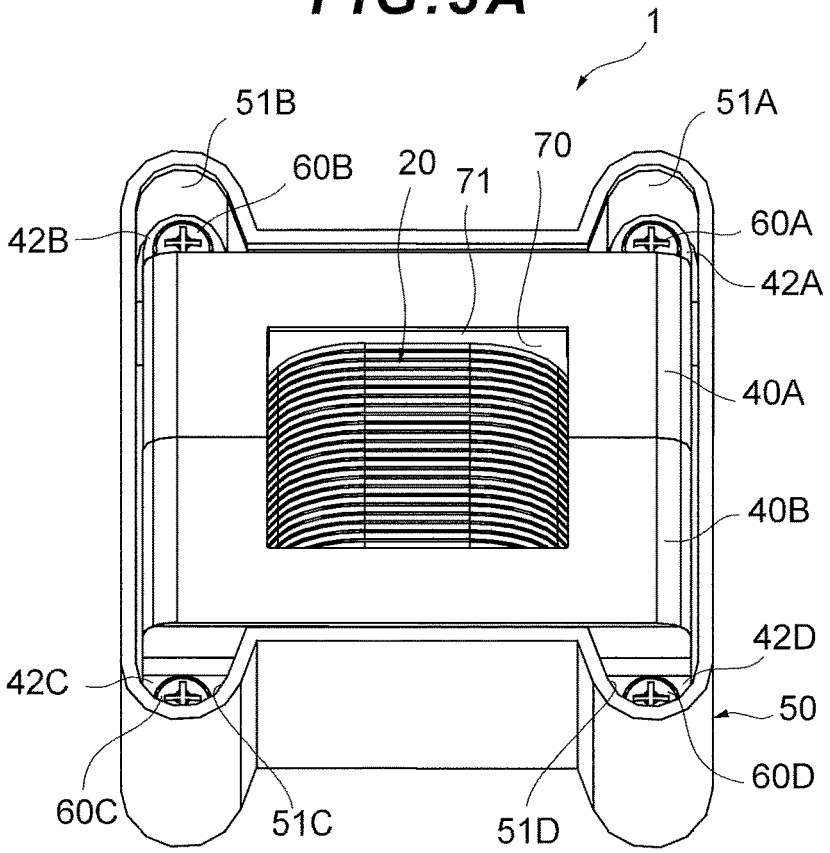
FIG. 3A is a perspective view showing an overall external view of the reactor.
Figure 3B:
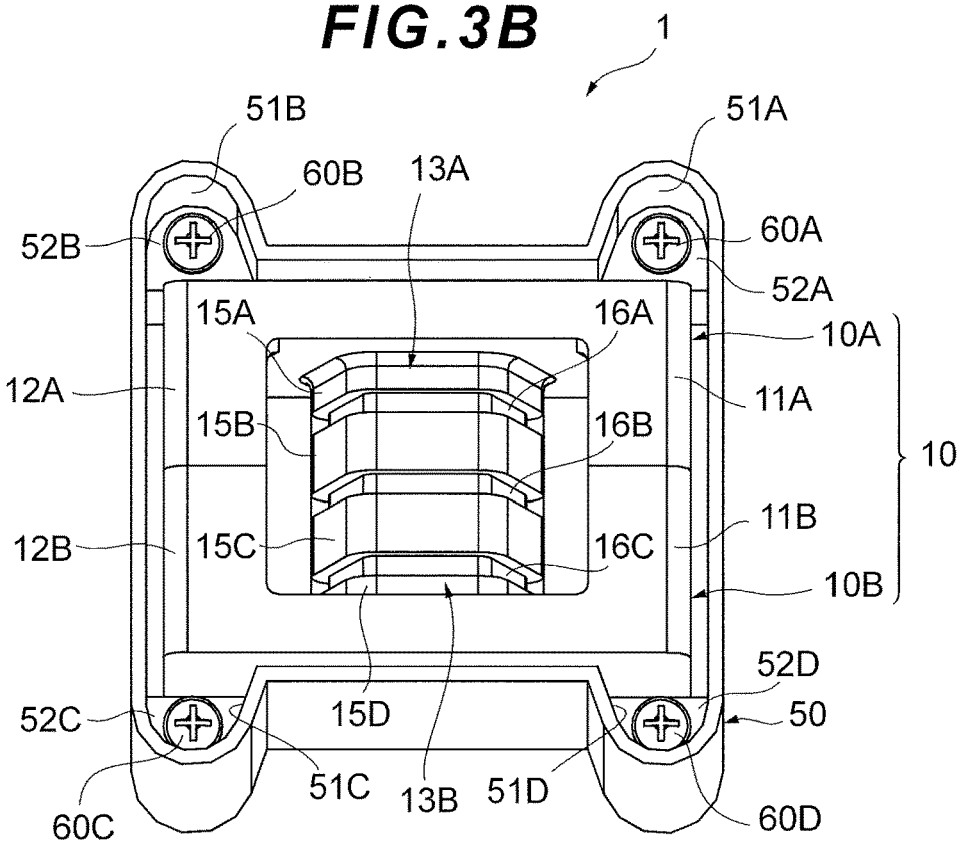
FIG. 3B is a perspective view showing an inside of the reactor from which bobbins and the coil part are removed according to the embodiment in FIG. 1 of the present invention.

Moreover, as shown in FIG. 2 and FIG. 3B, the central leg parts 13A, 13B are formed into a configuration in which a magnetic portion and a spacer portion (magnetic body or non-magnetic body) are alternately arranged. More specifically, the magnetic portion is formed of a central projection part 15A of the partial core 10A, magnetic core pieces 15B, 15C in the trapezoidal shape in the cross section, and a central projection part 15D of the partial core 10B, and first spacers 16A, 16C and a second spacer 1613, each being the non-magnetic portion are interposed into a place between the portions respectively, for these four magnetic portions. In addition, a trapezoidal cross section of the spacers 16A to 16C each is formed to be one size smaller than a trapezoidal cross section of parts 15A to 15D each in the magnetic portions.

Thus, the central leg parts 13A, 13B are configured of the magnetic portions divided into four, and three non-magnetic portions arranged between these magnetic portions and one interval between the magnetic portions is shortened, and therefore a magnetic flux leak quantity as a total can be reduced.

With regard to the number of the magnetic portions to be divided and the number of the non-magnetic portions positioned therebetween, the number other than the above-described number can be obviously applied.

FIG. 3A shows an overall external view of the reactor 1. However, the partial cores 10A, 103 are not illustrated in the external view because the cores are covered by other members, and therefore are illustrated in FIG. 33 in which bobbins 40A, 403 and the coil part 20 are removed.

More specifically, the respective partial cores 10A, 103 are covered by the bobbins 40A, 40B each that keep insulation of the cores from the coil part 20 or the like. Moreover, the bobbins 40A, 403 are formed by being butted to each other in a state in which the bobbins 40A, 403 cover the respective partial cores 10A, 10B (a leading end of a leg part of the core is not covered). Further, respective angle portions are provided with jut-out parts 42A to 42D jutting out outward, respectively.

An aluminum case 50 is formed so as to store the thus assembled bobbins 40A, 403 as a whole. Moreover, respective corner parts of the case 50 are provided with protrusion parts 51A to 51D protruding outward, and the jut-out parts 42A to 42D of the bobbins 40A, 403 are formed to be housed by the protrusion parts 51A to 51D.

Thus, outer side surfaces of the above-described bobbins 40A, 40B are formed to be abutted on an inner wall surface of the case 50, and the bobbins 40A, 40B are just stored within the case 50.

Through holes (not shown) are perforated in the respective jut-out parts 42A to 42D of the bobbins 40A, 40B, and screws 60A to 60D are configured to be screwed, through the through holes, into upper surfaces of stepped parts (52A to 52D) rising from a bottom part of the case 50. More specifically, the bobbins 40A, 403 as a whole are pushed down toward the bottom part of the case 50 by screwing the screws 60A to 607 thereinto, lower end surfaces of the bobbins 40A, 40B, being portions covering the central leg parts 13A, 13B, press an inner peripheral surface of the coil part 20 downward, and a lower outer peripheral surface of the coil part 20 is to be pressed onto an upper surface of the heat transfer sheet 30.

The matters described above are obvious also from FIG. 4 showing an internal state in which, while a lower end surface of a bobbin 40A covering a central leg part 13A is abutted on inner peripheral part of a lower base portion of a coil part 20, an upper end surface of the bobbin 40A faces, with spacing, an inner peripheral part of an upper base portion of the coil part 20, and is not abutted on the coil part 20.

Thus, the heat generated in the coil part 20 can be effectively dissipated to outside through the heat transfer sheet 30.

In addition, the heat transfer sheet 30 faces the heat sink (not shown) through the bottom surface wall part of the case 50, and the heat transferred to the heat transfer sheet 30 is dissipated from the heat sink to outside.

Thus, an assembly of the core part 10, the coil part 20, and the bobbins 40A, 40B can be integrally clamped to the case 50 with screws. In addition, the respective members are practically adhered to each other with an adhesive, when necessary, in a state of being positioned to each other. Moreover, as described later, a relative position between the respective members is fixed by filling an insulating adhesive between the respective members.

As described above, in the present embodiment, an insulating resin agent 71 of a silicon base, a urethane base, an epoxy base and the like is filled into a central hole 70 surrounded by the bobbins 40A, 40B. Such a resin has fluidity in an initial state, and therefore is infiltrated into a gap between the core part 10 and the coil part 20, and the insulation between both can be improved. Moreover, the insulation can be ensured by using such an insulating resin agent 71, even if the gap between both described above is small. Therefore, a clearance can be made small, and compactification can be promoted.

More specifically, as shown in FIG. 3A, the reactor 1 according to the present embodiment is configured in such a manner that the central hole 70 surrounded by the bobbins 40A, 40B is configured in a state in which the bobbins 40A, 40B are assembled, and the insulating resin agent 71 having flowability is filled into the central hole 70 (filled into an uppermost part of the central hole 70), and over-molding including the coil part 20 as a whole can be made. Thus, the insulating resin agent 71 is penetrated into the gap between the core part 10 and the coil part 20, and the insulation between both can be ensured.

Thus, it is preferable that a configuration is formed, in which an opening position of the central hole 70 of the bobbins 40A, 40B is set to be higher than an upper surface of the upper base of the coil part 20, and when the insulating resin agent 71 is filled into the central hole 70 surrounded by the bobbins 40A, 40B, the insulating resin agent 71 filled therein causes no overflow to outside, and the coil part 20 can be wholly covered with the insulating resin agent 71.

Moreover, the insulating resin agent 71 functions as a protective layer, and is capable of preventing occurrence of the respective members being damaged when the respective members are brought into contact with a member outside the reactor.

In the present embodiment, the insulating resin agent 71 is designed to be filled only into the central hole 70 surrounded by the bobbins 40A, 40B, and in comparison with a case where the outer periphery of the bobbins 40A, 40B is wholly filled with the insulating resin agent 71, an amount of filling the insulating resin agent 71 can be significantly reduced. A unit price of the insulating resin agent 71 is high, and therefore according to the present embodiment, a production cost can be significantly reduced.

In addition, even if the outer periphery of the bobbins 40A, 40B is wholly covered with the insulating resin agent 71, the insulation and advantages of protection are not necessarily high, and therefore it is considered that no significant problem would occur even by filling the insulating resin agent 71 only into the central hole 70.

The above-described core part 10 is formed of a powder magnetic core prepared by pulverizing a ferromagnetic material such as iron powders into fine powders, covering surfaces thereof with an insulating coat, and compressing and compacting the powders. Specific examples of the above-described ferromagnetic material include pure iron or an iron alloy containing at least one kind of additive element selected from elements of Ni, Cu, Cr, Mo, Mn, C, Si, Al, P, B, N and Co.

Moreover, the above-described coil part 20 is formed by winding the rectangular wire therearound. The rectangular wire is a band-shaped flat conducting wire, as shown in FIG. 1 or the like, in which a thickness of about 0.5 mm to about 6.0 mm and a width of about 1.0 mm to about 16.0 mm are applied as a general shape, for example.

In addition, as shown in FIG. 3A, the bobbins 40A, 40B have been formed into outer shapes to be one size larger than sizes of the partial cores 10A, 10B, respectively, in order to cover the core part 10, and taking into account moldability, mass productivity, fine processing, electric insulation, inexpensiveness, mechanical strength and the like, the bobbins 40A, 40B are molded by using an insulating resin such as a thermoplastic resin including PPS and 6,6-nylon, and a thermosetting resin including a phenolic resin and unsaturated polyester, for example.

The case 50 is formed of aluminum, but various other materials can be used therefor.

Figure 4:
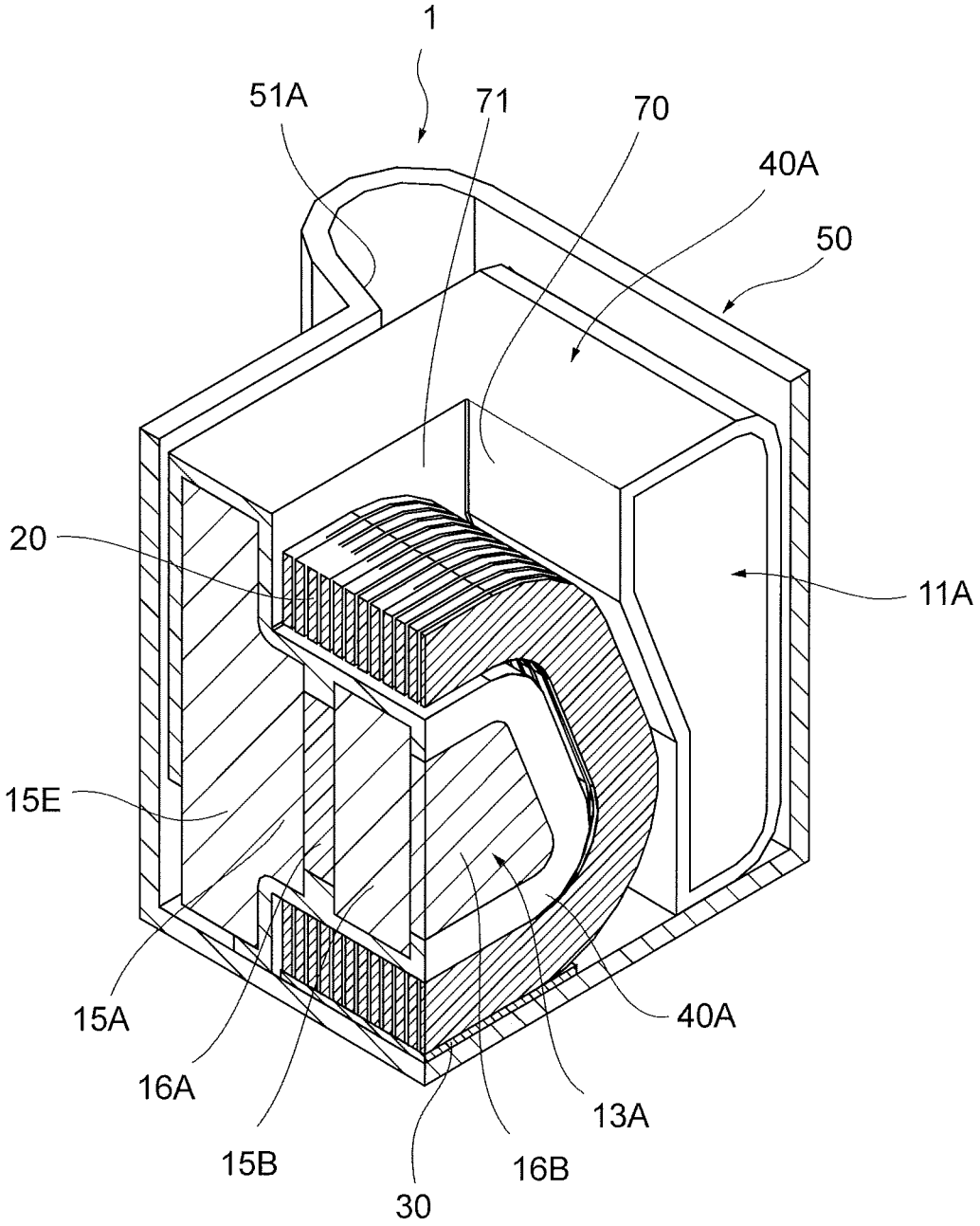
FIG. 4 is a cross-sectional perspective view showing the inside of the reactor according to the embodiment in FIG. 1 of the present invention.

Moreover, as shown in FIG. 4, if a core cross section is narrowed in any place relative to a magnetic flux flowing through the core part 10 (combination of two partial cores 10A, 10B), magnetic characteristics are deteriorated by this portion. Therefore, in the present embodiment, areas of the cross sections perpendicular to a direction in which the magnetic flux flows are designed to have substantially same values. Specifically, also in the partial core 10A shown in the figure, the areas of the cross sections perpendicular to the direction in which the magnetic flux flows, for example, an area of a leading end surface of the right and left leg part 11A and an area of a cross section of a root portion of the central leg part 13A (T-shaped portion combining a central protrusion part 15A and a core part body part 15E) are formed to be substantially equal to each other.

Either a cross-sectional area of the right and left leg part 11A or a cross-sectional area of the central leg part 13A can be obviously set to be larger depending on circumstances. For example, the cross-sectional area of the right and left leg part 11A can also be formed to be larger under a purpose of increasing an initial L value.

Moreover, as shown in FIG. 4, in cross-sectional shapes of the central leg part 13A and the right and left leg parts 11A, 12A, perpendicular to a direction in which the central leg part 13A extends, while a right and left width in a direction of arranging the leg parts is larger in the central leg part 13A, a vertical length in a direction perpendicular to the direction of arranging the leg parts is formed to be longer in the right and left leg parts 11A, 12A, and cross-sectional areas of the cross-sectional shapes are set so as to come close to each other. Even in this case, one cross-sectional shape described above can be set to be larger than the other cross-sectional shape, according to the circumstance.

Moreover, as described before, in the present embodiment, the cross-sectional shape of the right and left leg part 11A is formed into a particular shape and the coil part 20 of the central leg parts 13A, 13B is formed into a trapezoidal shape, and therefore each is configured to be wide in an upper portion and narrow in a lower portion so as to come along the outer peripheral part of the coil part 20. Thus, while efficiency of the space is improved, magnetic characteristics can be effectively improved.

Incidentally, in the present embodiment, as described above, the central leg parts 13A, 13B are configured into the trapezoidal shape in the cross section, and the shape of the coil part 20 wound therearound is formed to be the trapezoidal shape in the cross section. The reason why the coil part 20 is formed into the trapezoidal shape in the cross section is to increase a ratio of a length of the coil part 20 abutting on the heat transfer sheet 30 relative to a total length of the coil part 20. More specifically, if the shape is formed into the trapezoidal shape in the cross section, the lower base becomes longer than the upper base. Therefore, if both side pieces have the same length, the ratio of the coil part 20 abutting on the heat transfer sheet 30 increases in comparison with the case of a rectangle in the cross section, and a heat dissipating effect can be improved as a theory.

Figure 5:
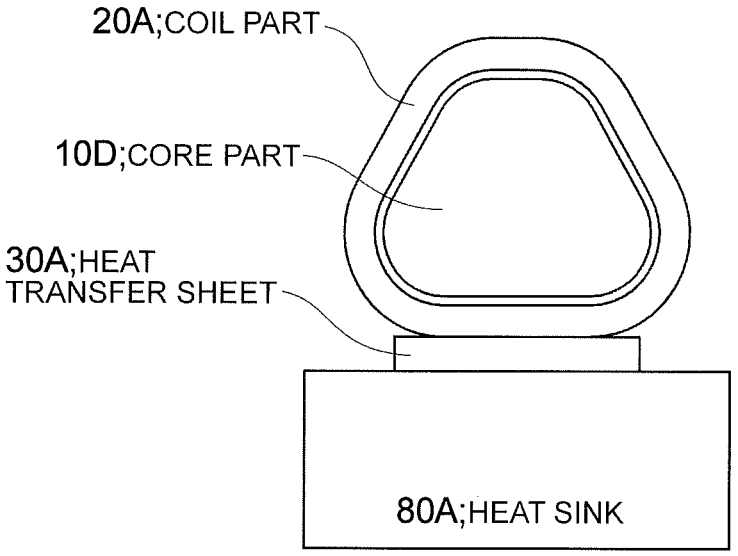
FIG. 5 is a diagram schematically showing the reactor according to the embodiment in FIG. 1 of the present invention.

FIG. 5 shows an aspect in which an outer peripheral surface of a coil part 20A is abutted on a heat transfer sheet 30A in contact with a heat sink 80A when a core part 10D and a coil part 20A each have a trapezoidal shape (trapezoid-like shape). FIG. 5 shows an aspect in which, when the coil part 20A has the trapezoidal shape in the cross section, a ratio of contact of the heat transfer sheet 30A with the outer peripheral surface of the coil part 20A increases.

From such a viewpoint, as the upper base is made smaller than the lower base, the heat-dissipating effect can be improved. Accordingly, a triangle shaped material in which the upper base is made smallest to a limit can cause further improvement in the heat-dissipating effect.

Figure 6:
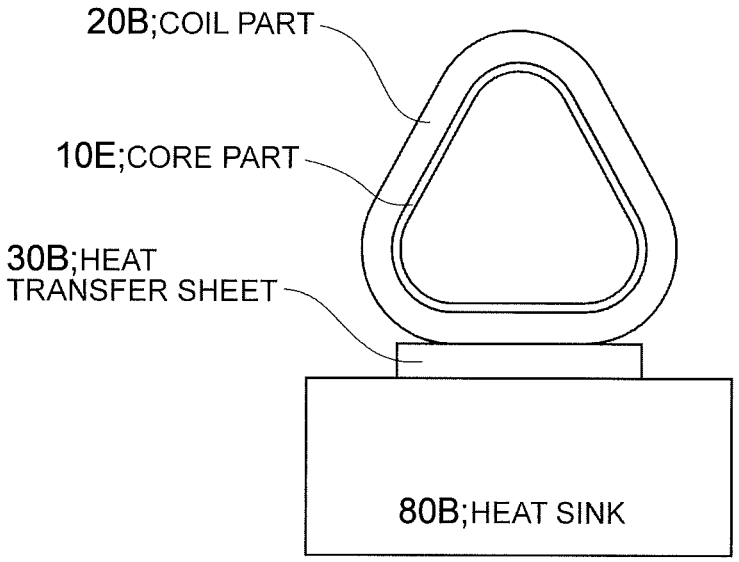
FIG. 6 is a diagram schematically showing a reactor according to a modified shape of the present invention.

FIG. 6 shows a concept of a reactor according to a modified shape of the present invention, and shows an aspect in which, when a core part 10E and a coil part 20B each have a triangular shape in a cross section (triangle-like shape), an outer peripheral surface of the coil part 20B is abutted on a heat transfer sheet 30B in contact with a heat sink 80B. FIG. 6 shows an aspect in which, when the coil part 20B has the triangular shape in the cross section, a ratio of contact of the heat transfer sheet 30B with the outer peripheral surface of the coil part 20B further increases. However, when the coil part 20B is formed into the triangular shape, an interior angle becomes acute at an apex of the triangle, and it becomes difficult to fold the rectangular wire in a longitudinal direction. In particular, when the angle is significantly below 60 degrees, the rectangular wire is liable to be damaged during folding, and therefore, it is important to take into account that the interior angle is formed to be 60 degrees or more.

Figure 7:
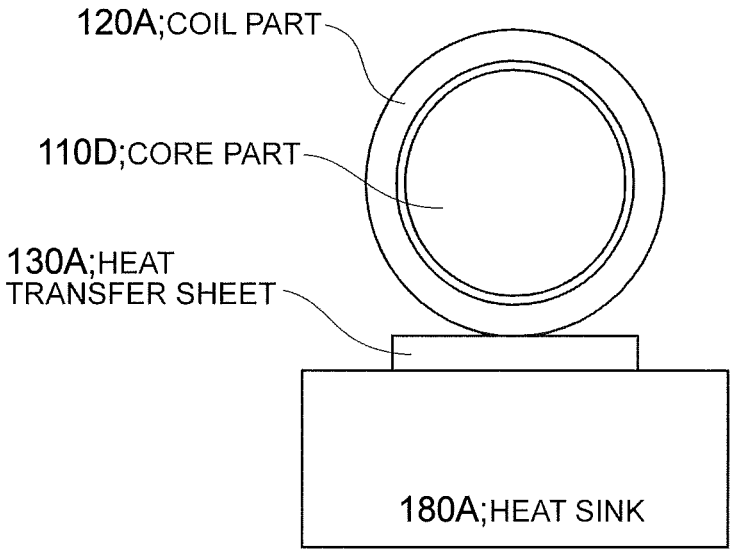
FIG. 7 is a diagram schematically showing a reactor according to a conventional technology 1.

Meanwhile, FIG. 7 shows a concept of a reactor according to a conventional technology 1, and shows an aspect in which, when a core part 110D and a coil part 120A each have a circular shape in a cross section (circle-like shape), an outer peripheral surface of the coil part 120A is abutted on a heat transfer sheet 130A in contact with a heat sink 180A. FIG. 7 shows an aspect in which, when the coil part 120A has the circular shape, the outer peripheral surface of the coil part 120A and the heat transfer sheet 130A are substantially formed into a point contact (practically, line contact), heat-dissipating properties significantly decrease.

Figure 8:
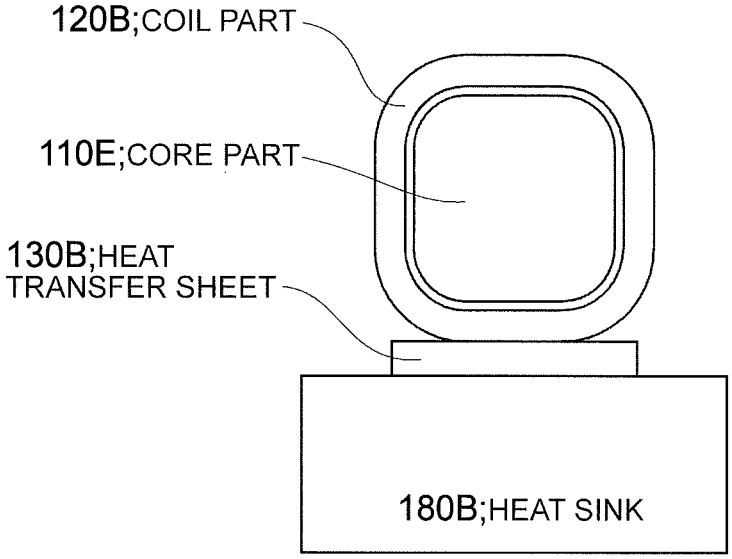
FIG. 8 is a diagram schematically showing a reactor according to a conventional technology 2.

Moreover, FIG. 8 shows a concept of a reactor according to a conventional technology 2, and shows an aspect in which, when a core part 110E and a coil part 120B each have a square shape in a cross section (square-like shape), an outer peripheral surface of the coil part 120B is abutted on a heat transfer sheet 130B in contact with a heat sink 180B. FIG. 8 shows an aspect in which, when the coil part 120B has the square shape, a side positioned downward has a length equal to a length of a side positioned upward, and in comparison with the case where the coil part 20A is formed into the trapezoidal shape as in the embodiment described above or the coil part 20B is formed into the triangular shape as in the modified shape described above, a ratio of contact of the heat transfer sheet 1303 with the outer peripheral surface of the coil part 1203 decreases, and therefore heat-dissipating properties are reduced.

Moreover, in the present embodiment, a technique of insert molding is applied thereto upon producing the reactor 1.

More specifically, the core part 10 is molded, and then the core part 10 and the coil part 20 are set inside an insert molding machine in a state in which both are stored inside the case 50 as shown in FIG. 3A, and further filling the insulating resin agent 71 into the central hole 70 of the bobbins 40A, 40B, and then integral molding processing is applied thereto in a mold.

Thus, the reactor 1 as a whole can be integrated quickly and reliably while the insulation is maintained.

Modified Embodiment

A coil component according to the present invention is not limited to a material in the above-described embodiment and the above-described modified shape, and can be modified into various other aspects.

For example, the cross sectional shape of the core part or the coil part is not limited to the shape in the above-described embodiment and in the above-described modified shape, and can be modified into various shapes or types other than the above-described shapes or types. For example, a pentagon-shaped core part or coil part can be used in place of the above-described core part or coil part having the trapezoidal shape in the cross section. In this case, it is necessary to take into account that the interior angle at the apex increases and a risk of the rectangular wire being damaged during folding the rectangular wire becomes small, but on the other hand, the number of steps required for folding the rectangular wire increases, and production efficiency is reduced.

It is preferable that, when the cross-sectional shape of the above-described coil part is formed into the trapezoidal shape, upon taking into account the shape from a viewpoint of efficiency, the coil part is formed in such a manner that the lower base has a length as large as one and a half times or more a length of the upper base, and a minimum of interior angle is 60 degrees or more.

Moreover, it is preferable that, in general, when the cross sectional shape of the above-described coil part is formed into a square or pentagon other than the trapezoid, upon taking into account the shape from the viewpoint of efficiency, the coil part is formed in such a manner that a length of a side abutting on the heat transfer sheet is in a maximum length among all sides and a minimum of interior angles becomes 60 degrees or more.

Moreover, in the reactor 1 according to the present embodiment, leading ends of the leg parts 11A, 11B, 12A, 12B, 13A, 13B corresponding to the respective E-shaped partial cores 10A, 10B are butted to each other and combined. However, leading end portions with each other may be chamfered so as to form a curved shape as a whole. Favorable DC superimposition characteristics can be achieved by forming each of the leading end portions into such a curved shape.

Hereinafter, the reactor according to Examples of the present invention will be described while comparing with Comparative Example.

EXAMPLES

Figure 9A:
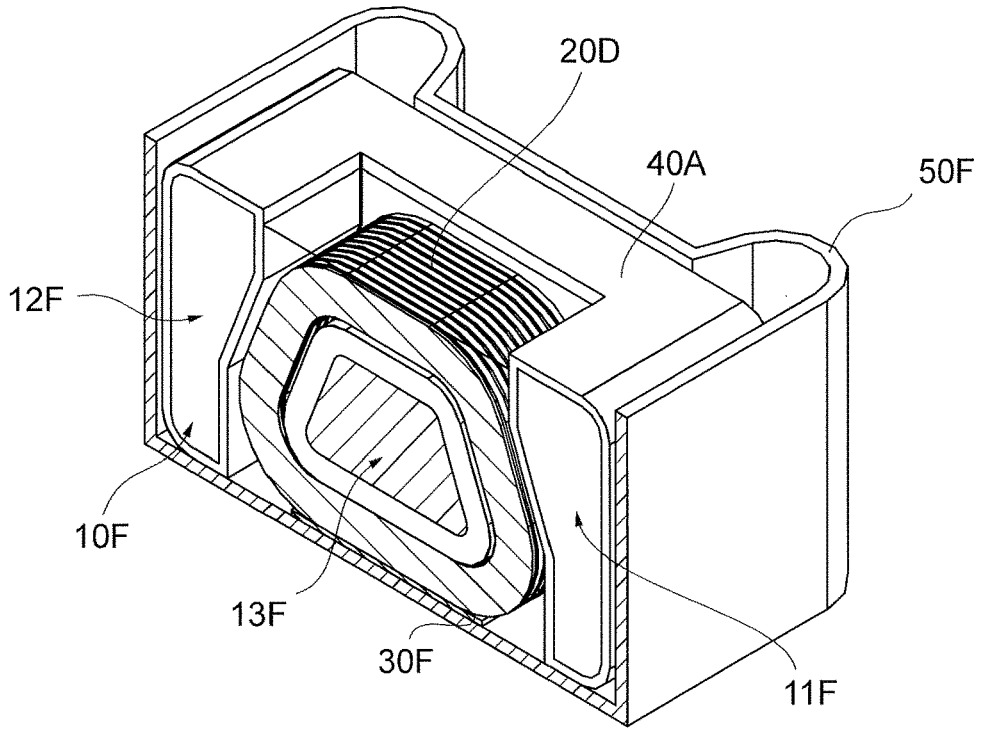
FIG. 9A is a diagram showing a shape in Example.
Figure 9B:
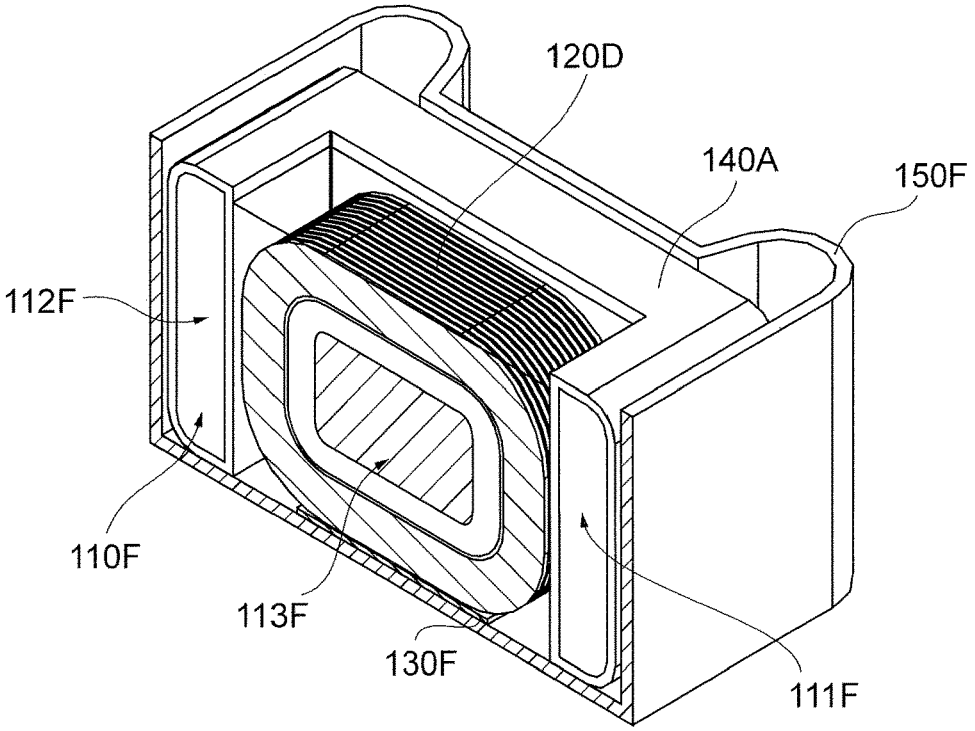
FIG. 9B is a diagram showing a shape in Comparative Example, to be assumed upon comparing heat generation between Example (trapezoidal) and Comparative Example (rectangular)

As Example, a sample in Example was prepared by forming a core part 10F and a coil part 20D each having a trapezoidal shape in a cross section as shown in FIG. 9A, similar to an embodiment, and setting thermal conductivity (W/m·k) of each member as shown in Table 1. Simultaneously therewith, as Comparative Example, a sample in Comparative Example was prepared by forming a core part 110F and a coil part 120D each having a rectangular shape in a cross section as shown fern FIG. 9B, and setting thermal conductivity (W/m·k) of each member as shown in Table 1.

In addition, cross-sectional areas of central leg parts 13F, 113F and cross-sectional areas of right and left leg parts 11F, 12F and 111F, 112F were set to be equal to each other between Example and Comparative Example. Moreover, a distance between the core part 10F and the coil part 20D and between the core part 110F and the coil part 120D was set to 2.3 mm for all the samples in Example and Comparative Example. Other members each were formed into the same size. Moreover, an insulating resin agent 71 was filled only into a central hole 70 in the embodiment.

An atmospheric temperature was set to 85° C. (under no wind) in both Example and Comparative Example.

A heat-dissipating effect was evaluated on the sample in Example and the sample in Comparative Example each prepared as described above by simulating a case upon passing, through the coil part 20D or 120D, a current having a waveform obtained by superimposing a high frequency ripple current on. DC 100 A, under the above-described conditions, and deriving an average temperature (average temperature inside each component) and a maximum temperature (temperature on a site to be a maximum temperature within the component) at a time after elapse of 3,000 seconds from start of passing the current therethrough, and calculating the heat-dissipating effect from the temperatures derived therefrom.

As shown in Table 2, between Example and Comparative Example, the temperatures in the coil part 20D and the coil part 120D were different by 3.55° C. in an average value. More specifically, in the sample in Example, the heat-dissipating effect superb as high as 3.55° C. was obtained in the average value in comparison with the sample in Comparative Example. In comparison of temperature rise values, in the sample in Example, measurement results superb as high as 7.6% were obtained in comparison with the sample in Comparative Example.

Figure 10A:
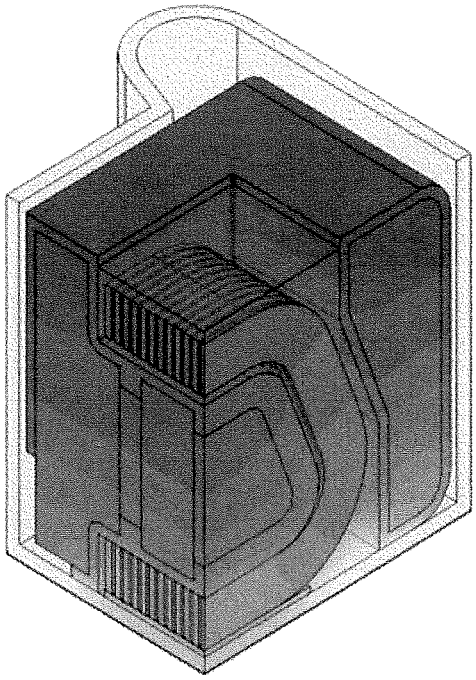
FIG. 10A is a diagram showing a temperature distribution in Example (trapezoidal)
Figure 10B:
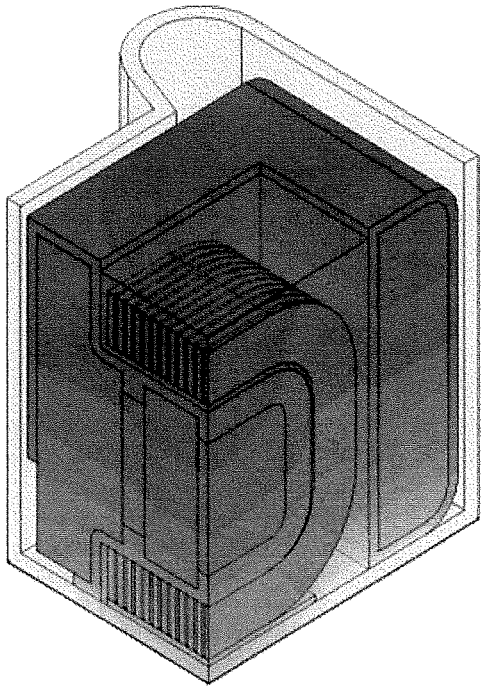
FIG. 10B is a diagram showing a temperature distribution in Comparative Example (rectangular).

Moreover, as shown in FIG. 10A and FIG. 10B, with regard to a temperature distribution, it is obvious that a cooling effect from a heat sink (lower part) is further effectively obtained in the sample in Example (FIG. 10A) than the sample in Comparative Example (FIG. 10B).

TABLE 1

| Thermal conductivity of each component | | | | | |
|---|---|---|---|---|---|
| Component | Core part | Coil part | Bobbin | Spacer (including first and second spacers) | Filler |
| Thermal conductivity W/m · k | 17.9 | 400 | 3 | 3 | 1.9 |

TABLE 2

| | | Core part | Central leg core | Coil part | Bobbin | First spacer | Second spacer | Filler |
|---|---|---|---|---|---|---|---|---|
| Example | Average (3000 s) temperature | 107.13 | 107.00 | 101.60 | 103.02 | 107.56 | 107.60 | 101.61 |
| | Maximum temperature | 115.60 | 112.30 | 112.90 | 115.60 | 112.30 | 112.00 | 114.60 |
| Comparative Example | Average (3000 s) temperature | 107.21 | 110.35 | 105.15 | 103.85 | 110.35 | 110.84 | 104.73 |
| | Maximum temperature | 117.20 | 115.10 | 115.40 | 117.20 | 114.80 | 114.90 | 116.50 |
| | Difference in average temperature | 0.08 | 3.35 | 3.55 | 0.83 | 2.78 | 3.24 | 3.12 |
| | Difference in maximum temperature | 1.60 | 2.80 | 2.50 | 1.60 | 2.50 | 2.90 | 1.90 |

Average: average temperature in a single component
Maximum: temperature in a site to be a maximum temperature within a single component
Temperature: ° C. in unit The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A reactor comprising:

a core part formed by central leg parts, and right and left leg parts respectively arranged on both sides of the central leg parts;

a coil part formed by winding a conducting wire around a circumference of the central leg parts, the central leg parts being formed by a plurality of magnetic core segments and a plurality of non-magnetic segments, the central leg parts being integrally formed by repeatedly alternating one magnetic core segment of the plurality of magnetic core segments and one non-magnetic segment of the plurality of non-magnetic segments, each of the plurality of non-magnetic segments having a smaller outer dimension than an outer dimension of each of the plurality of magnetic core segments; and a heat transfer sheet configured to dissipate heat in the coil part to outside of the reactor, the heat transfer sheet having a length that is less than or equal to a length of a side of the coil part on which the heat transfer sheet is located, the heat transfer sheet extending in a direction perpendicular to a winding direction of a circumference of the coil part, wherein:

the coil part is formed by a rectangular wire that is wound around the circumference of the central leg parts by edgewise winding, and an outer radial side of the circumference of the coil part wound around the circumference of the central leg parts is abutted against the heat transfer sheet.

2. The reactor according to claim 1, wherein the coil part is formed into a trapezoidal shape, in which a lower base on a side abutting on the heat transfer sheet has a length that is equal to one and a half times or more a length of an upper base in a winding shape of one turn in the coil part, and a minimum of interior angles is 60 degrees or more.

3. The reactor according to claim 1, wherein the coil part is formed into a triangle, a quadrangle, or a pentagon in a winding shape of one turn of the coil part, in which a length of a side abutting on the heat transfer sheet is in a maximum length among all sides, and a minimum of interior angles is 60 degrees or more.

4. The reactor according to claim 1, wherein, in cross-sectional shapes of the central leg parts and the right and left leg parts, perpendicular to a direction in which the central leg parts extend, and a right and left width in a direction of arranging the leg parts is larger in the central leg parts, a vertical length in a direction perpendicular to the direction of arranging the leg parts is formed to be longer in the right and left leg parts, and cross-sectional areas of the cross-sectional shapes are set so as to extend toward each other.

5. The reactor according to claim 1, wherein a configuration is formed, in which a length of bobbins of the right and left leg parts each is longer than a length of the coil part wound around the central leg parts, in a vertical direction being a direction perpendicular to a plane including the directions of the central leg parts and arranging the right and left leg parts, and when a sealing resin is filled into a space surrounded by the bobbins of the right and left leg parts, the sealing resin filled therein causes no overflow to outside, and the coil part is wholly covered with the sealing resin.

6. The reactor according to claim 1, wherein the coil part is formed by combining two substantially E-shaped partial cores in such a manner that leading end portions of three leg parts corresponding to each other are faced with each other.

7. The reactor according to claim 6, wherein the right and left leg parts of the partial cores are formed into a shape so as to come along an outer shape of the coil part wound, in a trapezoidal shape in a cross section, around a circumference of the central leg parts.

8. The reactor according to claim 5, further comprising an aluminum case in which the bobbins are wholly stored.

9. A method for producing a reactor, the method comprising:

arranging a core part in such a manner that a predetermined magnetic path is formed by providing central leg parts, and right and left leg parts so as to be arranged on both sides of the central leg parts, the central leg parts being formed by a plurality of magnetic core segments and a plurality of non-magnetic segments, the central leg parts being integrally formed by repeatedly alternating one magnetic core segment of the plurality of magnetic core segments and one non-magnetic segment of the plurality of non-magnetic segments, each of the plurality of non-magnetic segments having a smaller outer dimension than an outer dimension of each of the plurality of magnetic core segments;

forming a coil part by winding a conducting wire formed of a rectangular wire around a circumference of the central leg parts by edgewise winding; and pressing part of a circumference of the coil part wound therearound onto a heat transfer sheet configured to dissipate heat to outside of the reactor, the heat transfer sheet having a length that is less than or equal to a length of a side of the coil part on which the heat transfer sheet is located, the heat transfer sheet extending in a direction perpendicular to a winding direction of the circumference of the coil part, and an outer radial side of the circumference of the coil part wound around the circumference of the central leg parts is abutted against the heat transfer sheet.

10. The method for producing the reactor according to claim 9, comprising:

housing the core part and the coil part in bobbins covering the right and left leg parts;

setting a resulting material in an insert molding machine in a state in which the bobbins are wholly stored within a case;

filling an inside of the bobbins with an insulating resin agent through a filling hole part; and applying integral molding processing thereto within a mold.

* * * * *